US005295629A

United States Patent [19]

Satake et al.

[11] Patent Number: 5,295,629

[45] Date of Patent: Mar. 22, 1994

[54] VERTICAL TYPE GRAIN-MILLING MACHINE

[75] Inventors: Toshihiko Satake; Satoru Satake, Tokyo; Nobuhiro Matsumoto; Hiroyuki Fukumitsu, both of Hiroshima, all of Japan

[73] Assignee: Satake Corporation, Tokyo, Japan

[21] Appl. No.: 73,497

[22] Filed: Jun. 9, 1993

[30] Foreign Application Priority Data

Jun. 16, 1992 [JP] Japan ..... 4-182985

[51] Int. Cl.[5] ..... B02C 23/38

[52] U.S. Cl. ..... 241/57; 241/58; 241/74; 241/257.1; 241/260.1

[58] Field of Search ..... 241/8, 12, 57, 58, 74, 241/247, 248, 257.1, 260.1

[56] References Cited

U.S. PATENT DOCUMENTS

| | | | |
|---|---|---|---|
| 1,794,972 | 3/1931 | Mayer | 241/248 |
| 3,411,721 | 11/1968 | Delcellier | 241/257.1 X |
| 3,897,017 | 7/1975 | Rogers et al. | 241/257.1 X |
| 5,025,993 | 6/1991 | Satake | 241/74 |

FOREIGN PATENT DOCUMENTS 3-146137 6/1991 Japan .

*Primary Examiner*—Mark Rosenbaum
*Assistant Examiner*—Frances Chin
*Attorney, Agent, or Firm*—Fish & Richardson

[57] ABSTRACT

A vertical type grain-milling machine has a perforated bran removing cylinder arranged vertically with respect to a machine frame; a main shaft which is rotatably provided within the perforated bran removing cylinder; and a milling roll and a screw roll which are in abutment with each other and which are mounted on the main shaft, the milling roll being associated with a grain discharging section and the screw roll being associated with a grain supplying section. The perforated bran removing cylinder is surrounded by an air in-take frame which has a large number of through-holes for causing in-flowing air to have a downward component of orientation. The discharging of the bran externally of the machine is enhanced and the adherence of bran onto the inner wall of the air in-take frame and the perforated bran removing cylinder is prevented.

5 Claims, 4 Drawing Sheets

VERTICAL TYPE GRAIN-MILLING MACHINE

BACKGROUND OF THE INVENTION (1) Field of the Invention

The present invention relates to a grain-milling machine, and more particularly to a vertical type grain-milling machine in which grains are supplied from one side of a vertical bran removing cylinder for causing the grains to move up or move down while the grains are being subjected to milling action in the bran removing cylinder and the grains are discharged from the other side of the bran removing cylinder.

(2) Description of the Related Art

A conventional vertical type grain-milling machine of the kind to which the present invention relates has been disclosed in Japanese Patent Application Kokai (Laid Open) No. 146137/1991 in which the inventors are the same as those in the present application. By making reference to FIG. 1, such a conventional grain-milling machine is first explained to assist the understanding of the present invention.

As seen in FIG. 1, a vertical type grain-milling machine 100 is arranged such that, within a vertical perforated bran removing cylinder 101, a vertical shaft 102 carries a screw roll 103 and an abrasive milling roll 104 together with the screw roll 103 being disposed at a lower position and the abrasive milling roll 104 at an upper position of the vertical shaft 102. Grains are supplied to the screw roll 103 via a feeding chute 105 by a screw conveyor 106 and are elevated, by the rotating action of the screw roll 103, to a milling chamber formed between the bran removing cylinder 101 and the milling roll 104. Then, the grains are subjected to the milling action produced by the rotation of the abrasive milling roll 104, and the grains thus processed are discharged externally of the machine from an outlet 109 against the resistance generated by a resisting plate 110 via an outlet chute 111. The bran which has been removed from the grains due to the milling action within the bran removing cylinder 101 is drawn by a suction fan 115 and discharged externally of the machine through a number of perforations provided in the bran removing cylinder 101.

However, there have existed certain drawbacks in the conventional vertical type grain-milling machine described above. Specifically, although the bran is sufficiently discharged at that side of a surface 101*a* of the bran removing cylinder 101 which is close to the suction duct 116 connected to the suction fan 115, the bran discharging action at that side of a surface 101*b* of the bran removing cylinder 101 which is disposed opposite to the suction duct 116 is insufficient simply because the sucking force at that side is weaker. This results in the deterioration of bran removal from grains and in the clogging of the perforations of the bran removing cylinder 101.

SUMMARY OF THE INVENTION

It is, therefore, an object of the present invention to overcome the drawbacks existing in the conventional machine and technology as explained above and to provide an improved vertical type grain-milling machine in which it is possible to remove the bran quickly during the grain milling operation and to discharge the bran completely and stably during the long continuous milling operation.

According to one aspect of the invention, there is provided a vertical type grain-milling machine comprising:

a perforated bran removing cylinder arranged vertically with respect to a machine frame;

a main shaft which is rotatably provided within the perforated bran removing cylinder;

a milling roll and a screw roll which are in abutment with each other and which are mounted on the main shaft, the milling roll being associated with a grain discharging section and the screw roll being associated with a grain supplying section; and an air in-take frame which has a large number of through-holes for causing in-flowing air to have a downward component of orientation and which surrounds the perforated bran removing cylinder with a predetermined space being provided between the air in-take frame and the perforated bran removing cylinder.

The grains supplied to the screw roll from a grain supplying section of the grain-milling machine are fed by the screw roll to a milling chamber at which the grains are subjected to the milling action produced by the rotation of the milling roll, and the grains thus processed are discharged externally of the machine. The bran which has been removed from the grains due to the milling action within the milling chamber is, after being discharged through perforations in a bran removing cylinder into the bran removing chamber, moved to a bran collecting chamber, and is discharged externally of the machine by a bran discharging system. At this time, since the air is drawn in through a large number of the through-holes in an air in-take frame with the air being causes to have a downward component of orientation, the discharging of the bran externally of the machine is facilitated or enhanced and, at the same time, the adhering of the bran onto an inner wall of the air-intake frame is effectively prevented.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Now, preferred embodiments are explained with reference to the accompanying drawings.

Figure 2:
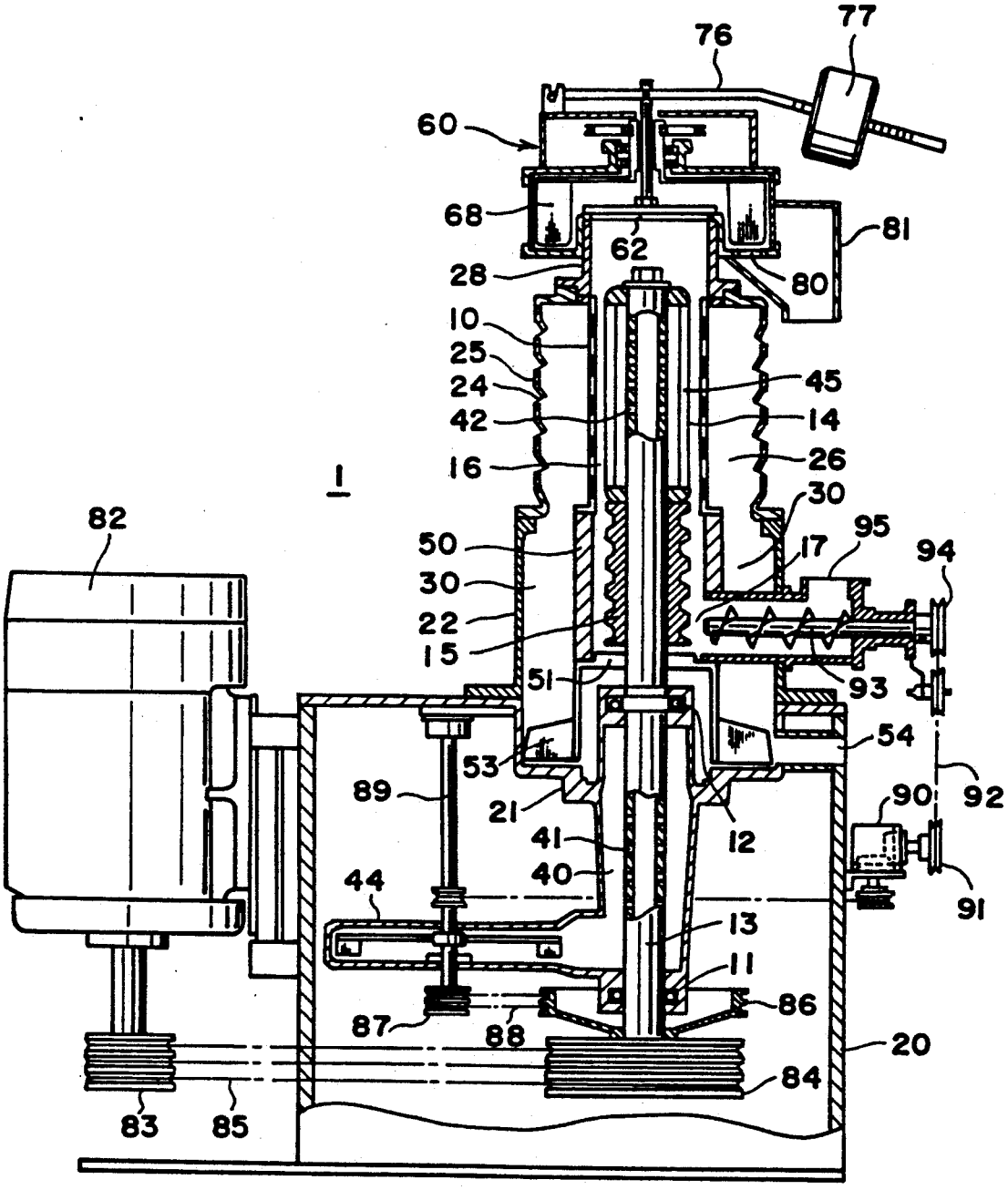
FIG. 2 is a sectional view of a vertical type grain-milling machine of an embodiment according to the present invention.
Figure 3:
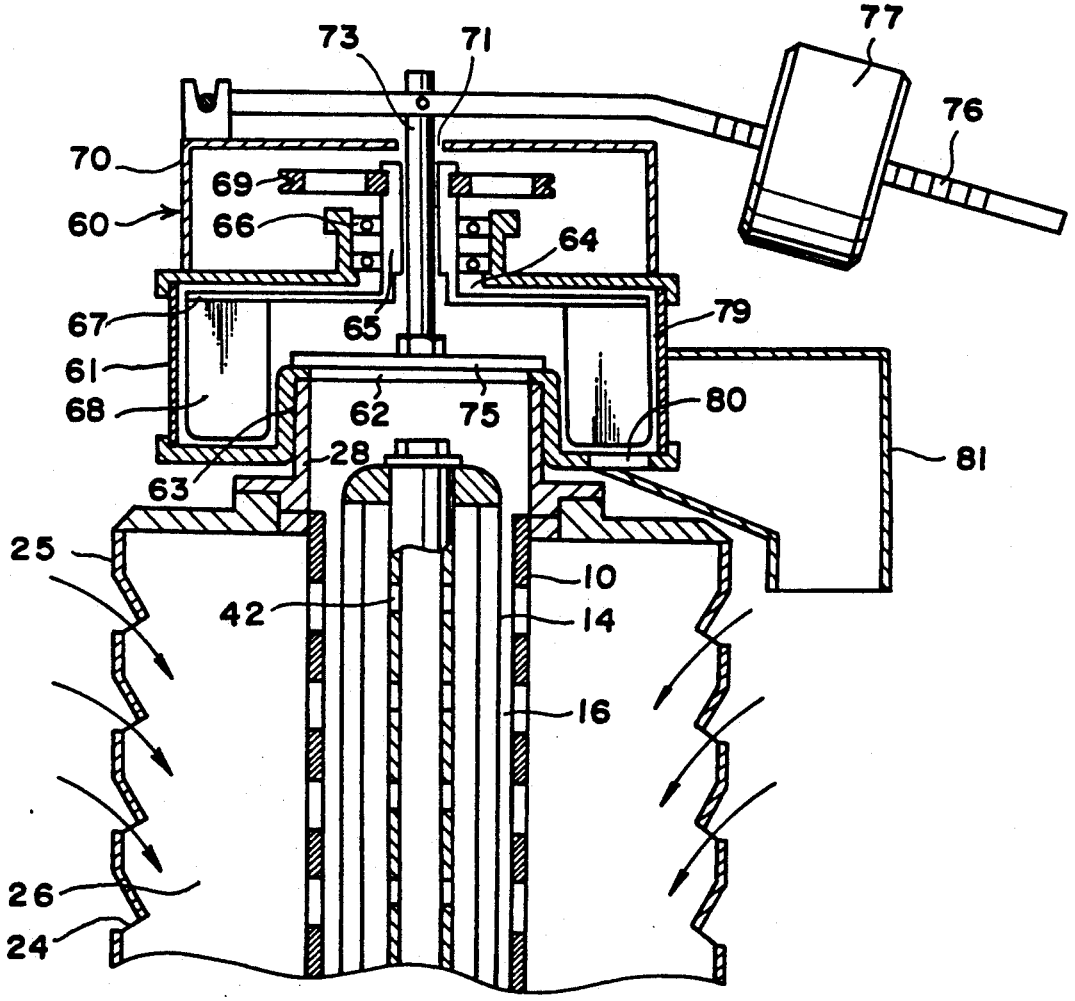
FIG. 3 is an enlarged sectional view of an upper part of the grain-milling machine of the first embodiment shown in FIG. 2.

FIG. 2 is a front view, partially in section, of a vertical type grain-milling machine of a first embodiment according to the invention, and FIG. 3 is an enlarged view, partially in section, of an upper portion of the grain-milling machine shown in FIG. 2.

As shown in FIG. 2, the vertical type grain-milling machine 1 is arranged such that, within a vertical perforated bran removing cylinder 10, there is provided a vertical shaft 13 which is rotatably supported by a lower bearing 11 and an upper bearing 12 and which carries a milling roll 14 at an upper position of the vertical shaft 13 corresponding to the position of the bran removing cylinder 10 and a screw roll 15 connected in abutment to a bottom end of the milling roll 14. The bottom end of the milling chamber 16 defined between the milling roll 14 and the bran removing cylinder 10 communicates, through the screw roll 15, with a grain supplying inlet 17 and the upper end of the milling chamber 16 communicates with a discharging cylinder 28.

A cylinder frame 21 is fixed in a machine base or frame 20 and a bran collecting cylinder 22 is fixed on the machine base 20. The bran collecting cylinder 22 communicates with the discharging cylinder 28 through an air in-take frame 25 which surrounds the perforated bran removing cylinder 10 and which is provided with a large number of through-holes 24. The bran removing cylinder 10 together with the air in-take frame 25 constitutes a bran removing chamber 26. In the air in-take frame 25, there are provided at its entire periphery a large number of through-holes 24 which allow the ambient air to flow into the bran removing chamber 26. It should be noted that the through-holes 24 are so arranged that they are oriented towards the lower end of the bran removing chamber 26 (as seen in FIG. 3 in an enlarged view) so that the ambient air may easily flow towards and into the bran collecting chamber 30 which is continuous from the lower end of the bran removing chamber 26.

A main shaft 13 is hollow with both the upper end and the lower end closed, and a plurality of air holes 41 and 42 are provided respectively in shaft portions located within an air supplying chamber 40 and at the milling roll 14. Also, the air supply chamber 40 communicates with a jet air fan 44. The milling roll 14 is hollow with jet air grooves (not shown) being provided along stirring bars 45 formed in a vertical direction. A disk 51 fixed to the main shaft 13 is in close contact to the bottom of a grain supply cylinder 50 and this disk 51 is provided with bran outletting blades 53 for discharging the bran fell down through the bran collecting chamber 30. A bran outlet 54 is disposed at a location tangential to the passage of the bran moved by the bran outletting blades 53. The bran outlet 54 communicates with bran collecting means (not shown) such as a suction device or a bag filter.

On the other hand, at the upper end portion of the discharging cylinder 28, there is provided a discharging system 60 for the grains having been processed. An enlarged sectional view of such portion of the device is shown in FIG. 3. As seen therein, a discharge opening 62 is provided at a central portion of the bottom of a cylindrical receiving chute 61 and, into the discharge opening 62, the upper end portion of the discharging cylinder 28 is inserted up to a point half way between the upper and lower surfaces of the receiving chute 61. The receiving chute 61 has centrally thereof an indented engaging portion 63 in a cylindrical shape for the upper end portion of the discharging cylinder 28 to be inserted and held therein, whereby a passage 79 in a ring shape is defined by the inner peripheral surface, the bottom surface of the receiving chute 61 and the indented engaging portion 63.

An opening 64 is provided at a central portion of the upper surface of the receiving chute 61 and the hollow shaft 65 is inserted in the opening 64 and is held rotatably by bearings 66. The lower end of the hollow shaft 65 faces the inner upper portion of the receiving chute 61 and carries a plurality of radially extending arms 67 from which a plurality of outletting blades 68 are respectively hanging at their free ends. On the other hand, the upper end portion of the hollow shaft 65 has a pulley 69 for the outletting blades 68, and a rod 73 extends through an opening 71 provided at a central portion of a cover 70 for the hollow shaft 65 and the pulley 69. A resistance plate 75 in a disk form is fixed to the lower end of the rod 73 and a weight lever 76 is pivotablly supported at its middle portion by the upper end of the rod 73. This weight lever 76 is pivoted at its one end to the cover 70 and a weight 77 is movably provided at the other end of the weight lever 76. In this way, the resistance plate 75 is pressed to the discharge opening 62 due to the weight 77. A discharge chute 81 communicating with a passage 79 and an outlet hole 80 and an outletting chute 81 extends out beyond the receiving chute 61. The outletting chute 81 and the receiving chute 61 (indented engaging portion 63) are rotatable 360° with the center of the discharging cylinder 28 as the axis.

Now, turning to FIG. 2 once again, the driving system involved is explained. A pulley 83 of a main motor 82 fixed at one side of the machine base 20 and a large diameter pulley 84 fixed to a lower portion of the main shaft 13 are interlockingly connected by a V-belt 85. A transient driving pulley 86 is fixed to the lower portion of the main pulley 13 and is connected to a fan pulley 87 of the jet air fan 44. A pulley provided at a middle portion of an intermediate shaft 89 carrying the jet air fan 44 is connected to a pulley 94 which drives a screw conveyer 93 by means of a gear box 90, a pulley 91 and a V-belt 92. The numeral 95 denotes a grain supplying section.

Now, the operation of the above described vertical type grain-milling machine of the first embodiment according to the invention is explained.

The main shaft 13 is rotated due to the rotating action of the main motor 82 by means of the motor pulley 83, the V-belt 85 and the large diameter pulley 84. The air jet fan 44 is driven by means of the transient pulley 86 fixed to the main shaft 13, the V-belt 88 and the fan pulley 87. The pulley 94 for driving a screw is rotated by means of the intermediate shaft 89, the gear box 90, the pulley 91 and the V-belt 92, and drives the screw conveyor 93. In this way, the grains (herein referred to as rice grains for convenience of explanation) conveyed to the supplying section 95 from the preceding process are forced to move into the supplying inlet 17 of the supply cylinder 50 by the screw conveyor 93 and to be elevated to the milling chamber 16 by the screw roll 15.

The rice grains thus elevated by the screw roll 15 move into the milling chamber 16 and fill the discharging cylinder 28, whereby the rice grains are subjected to pressure from the resistance plate 75 resulting in the development of an appropriate degree of resistance therein. Under such internal condition, the milling roll 14 rotates and the stirring bars 45 stir the rice grains and, due to the grain-to-grain friction, the epidermis of the rice grains are peeled off and the milling action thus progresses. On the other hand, the jet air produced by the jet air fan 44 proceeds to the milling roll 14 through the air supplying chamber 40, the air holes 41, the hollow main shaft 13 and the air holes 42, and blows into the milling chamber 16 through the jet air grooves (not shown).

The rice grains which have been processed in the milling chamber 16 and from which the bran has been removed are subjected to the elevation action of the screw roll 15 and are then forced out to the passage 79 in the receiving chute 61 from around the entire periphery of the discharge opening 62 against the resisting force produced by the resistance plate 75. The rice grains within the receiving chute 61 are continuously scraped off into the outlet hole 80 by the outletting blades 68, and are discharged externally of the machine through the discharge chute 81.

The epidermis or bran removed within the milling chamber 16 moves, due to the jet air from the jet air fan 44, passing through the bran removing cylinder 10, to the bran removing chamber 26 from the milling chamber 16. The ambient air is drawn into the bran removing chamber 26 through a large number of through-holes 24 which are provided in the air in-take frame 25 in such a way that the ambient air drawn in is oriented downwardly as shown in arrows in FIG. 3. Due to this arrangement, the bran is quickly introduced into the bran collecting chamber 30 and, at the same time, the adherence of the bran to the wall of the air in-take frame 25 and the bran removing cylinder 26 is effectively prevented.

The bran moved to the bran collecting chamber 30 accumulates in the bottom of the bran collecting chamber 30, and is discharged externally of the machine from the bran outlet 54 by means of the bran outletting blades 53. The bran discharged externally of the machine is transferred to a means such as a bag filter (not shown).

Figure 4:
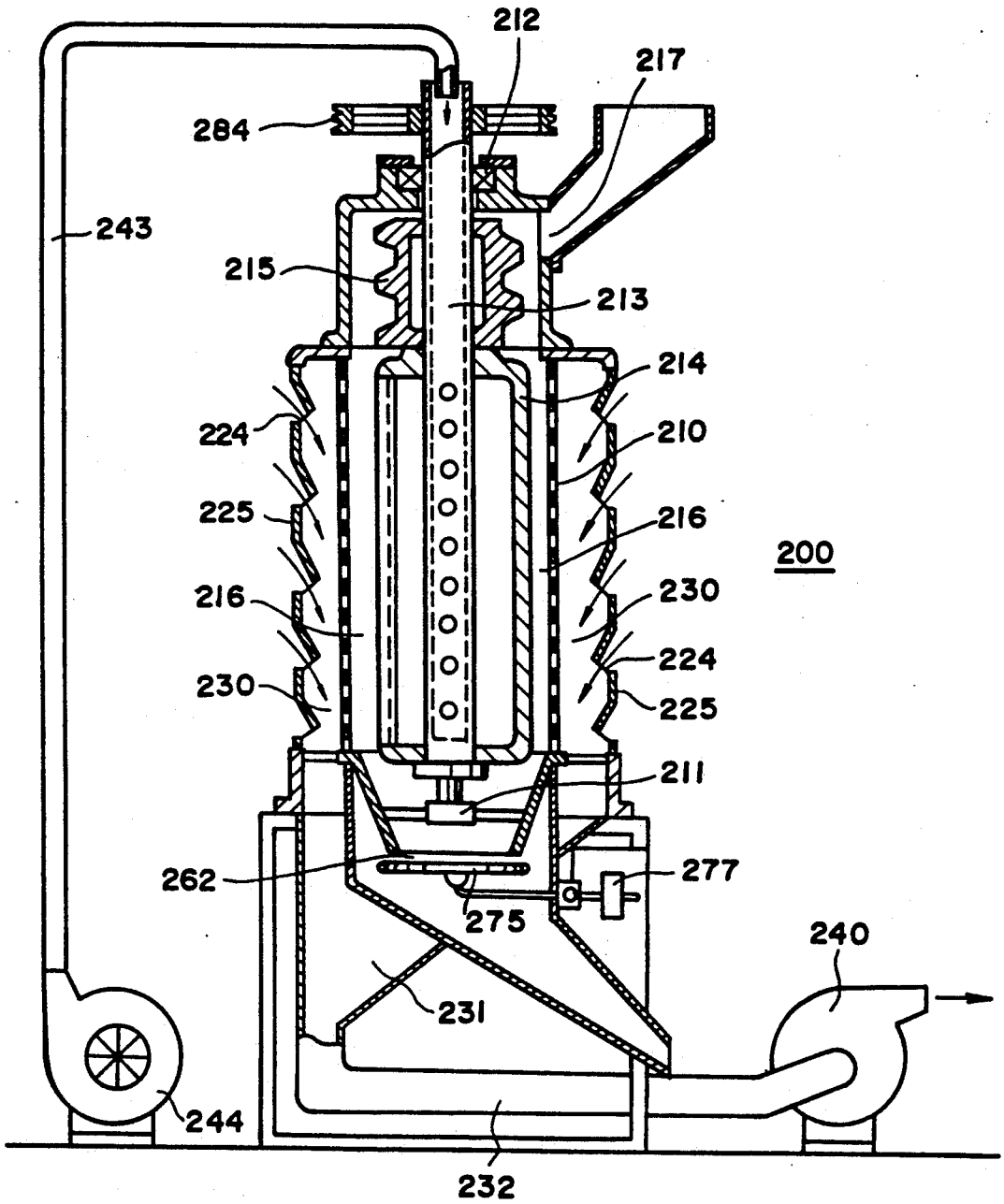
FIG. 4 is a sectional view of a vertical type grain-milling machine of another embodiment according to the present invention.

FIG. 4 is a front view, partially in section, of a vertical type grain-milling machine of a second embodiment according to the invention. Whereas the machine of the first embodiment explained above with reference to FIG. 2 is one in which the grains are supplied from the bottom side of the vertical bran removing cylinder, the vertical type grain-milling machine of this embodiment shown in FIG. 4 is arranged such that the grains are supplied from the top side of the bran removing cylinder and the grains having been subjected to the milling action are discharged from the bottom side of the bran removing cylinder.

With reference to FIG. 4, the general configuration of the vertical type grain-milling machine 200 may be explained as follows: The main shaft 213 having a hollow body is rotatably supported by an upper bearing 212 and a lower bearing 211. The large diameter pulley 284 is fixed to the main shaft 213 in the vicinity of its upper most portion and is driven by means of the main motor (not shown) and the V-belt (not shown). The upper end portion of the main shaft 213 communicates with an air supplying fan 244 through a duct 243. The screw roll 215 is fixed to the main shaft 213 at its upper portion and the milling roll 214 in abutment with the screw roll 215 is fixed to the main shaft 213 at its lower portion. The milling roll 214 is surrounded by the perforated bran removing cylinder 210 with a predetermine space being provided therebetween, thereby defining the milling chamber 216 between the milling roll 214 and the bran removing cylinder 210. The bran removing cylinder 210 is in turn surrounded by the ambient air in-take frame 225 with a predetermined space being provided therebetween, thereby forming the bran removing chamber 230 between the bran removing cylinder 210 and the air in-take frame 225. The air in-take frame 225 is provided over its entire periphery with a large number of through-holes 224 which cause the air to have a downward component of orientation as shown with arrows in FIG. 4. In the drawings, the numeral 217 denotes a grain supplying section and the numeral 275 denotes a resistance plate against which a force produced by a weight 277 constantly acts so as to close a discharging opening 262 for the grains.

The only difference in the arrangement of the machine of this embodiment as compared with that of the first embodiment shown in FIG. 2 is that the grain supplying section and the grain discharging section are reversed, so that the operations in the two embodiments are basically the same and specific explanations therefor are omitted here. In this second embodiment, too, the air in-take frame 225 is provided with a large number of through-holes 224 which cause the air drawn in to have a downward component of orientation and, with this arrangement, the bran is quickly moved to the bran collecting chamber 230 and also the adherence of bran to the inner wall of the air in-take frame 225 and the perforated bran removing cylinder is effectively prevented.

Figure 1:
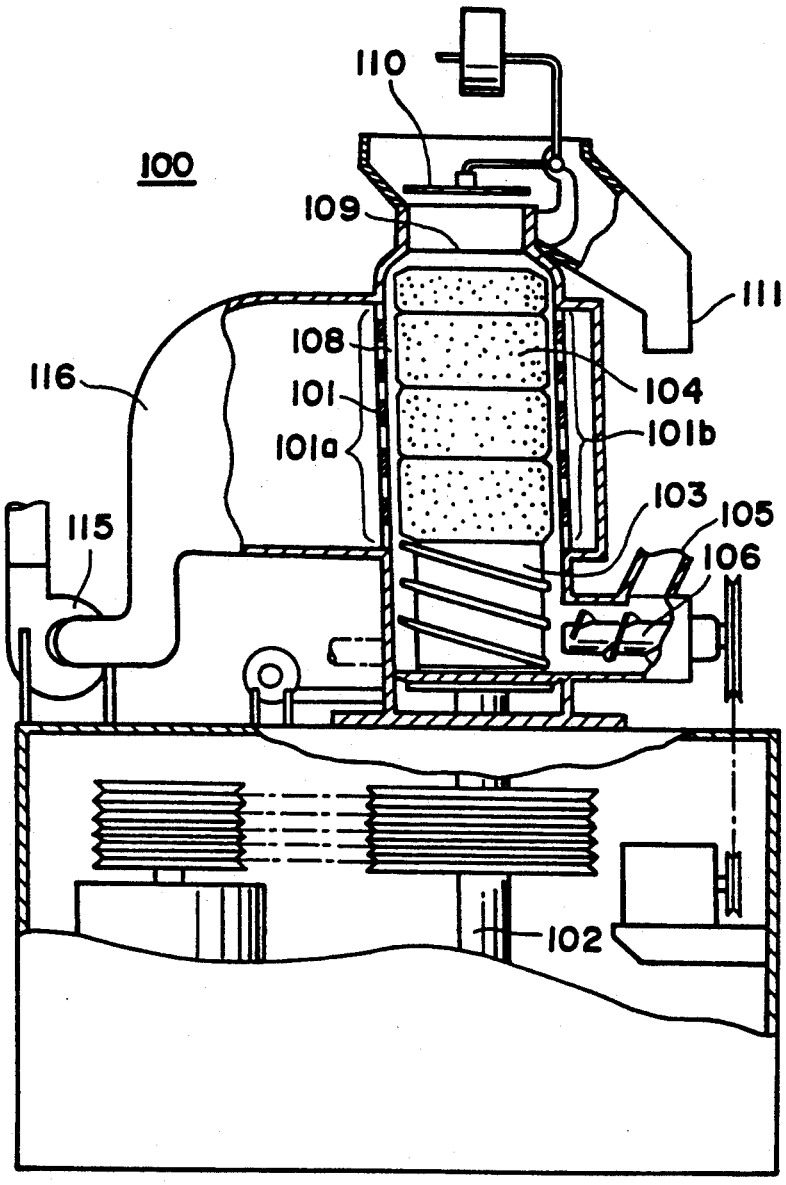
FIG. 1 PRIOR ART
FIG. 1 is a sectional view of the conventional vertical type grain-milling machine.

In explaining the embodiments of the invention, the milling roll has been illustrated and described as being a friction type roll. However, it is to be understood that such roll may be an abrasive type roll as seen in FIG. 1 or may be a combination of friction type and abrasive type rolls.

As has been explained hereinabove, since the vertical type grain-milling machine according to the invention has an air in-take frame provided with a large number of through-holes which cause the air drawn in to have a downward component of orientation, the discharging of the bran externally of the machine is enhanced and the adherence of bran to the inner wall of the air in-take frame and the perforated bran removing cylinder is prevented.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A vertical type grain-milling machine comprising:

a perforated bran removing cylinder arranged vertically with respect to a machine frame;

a main shaft which is rotatably provided within said perforated bran removing cylinder;

a milling roll and a screw roll which are in abutment with each other and which are mounted on said main shaft, said milling roll being associated with a grain discharging section and said screw roll being associated with a grain supplying section; and an air in-take frame which has a large number of through-holes for causing in-flowing air to have a downward component of orientation and which surrounds said perforated bran removing cylinder with a predetermined space being provided between said air in-take frame and said perforated bran removing cylinder.

2. A vertical type grain-milling machine according to claim 1, in which said milling roll and said screw roll are mounted on said main shaft at an upper position and a lower position, respectively.

3. A vertical type grain-milling machine according to claim 1, in which said milling roll and said screw roll are mounted on said main shaft at a lower position and an upper position, respectively.

4. A vertical type grain-milling machine according to claim 1, in which said milling roll is of a friction type.

5. A vertical type grain-milling machine according to claim 1, in which said milling roll is of a grinding type.

* * * * *